United States Patent [19]

Saxton

[11] Patent Number: 4,788,916

[45] Date of Patent: Dec. 6, 1988

[54] CUSHION POUCH TRAY

[76] Inventor: Nancy Saxton, 1201 E. North Shore Dr., Tempe, Ariz. 85283

[21] Appl. No.: 76,913

[22] Filed: Jul. 23, 1987

[51] Int. Cl.[4] ..... A47B 23/00

[52] U.S. Cl. ..... 108/43; 248/DIG. 10

[58] Field of Search ..... 248/205.2, 99, 100, 248/101, 444; 108/43; 297/462

[56] References Cited

U.S. PATENT DOCUMENTS

| | | | |
|---|---|---|---|
| 2,640,747 | 6/1953 | Bodenhoff | 108/43 X |
| 2,806,131 | 9/1957 | Palmer | 248/DIG. 10 |
| 3,779,419 | 12/1973 | Heitz | 248/99 X |
| 4,052,944 | 10/1977 | Jennings | 108/44 X |
| 4,130,263 | 12/1978 | Roericht | 248/DIG. 10 |
| 4,139,037 | 2/1979 | McGuigan | 248/100 X |
| 4,346,895 | 8/1982 | Brownlee | 248/DIG. 10 |
| 4,503,780 | 3/1985 | Apissomian | 108/27 |
| 4,620,681 | 11/1986 | Staley, III et al. | 248/99 X |
| 4,659,144 | 4/1987 | Reese | 297/184 |

FOREIGN PATENT DOCUMENTS

| | | | |
|---|---|---|---|
| 606661 | 3/1959 | Italy | 131/241 |

OTHER PUBLICATIONS

Copies of Pictures Showing a Pouch Equipped Ashtray and a Cushion Equipped Desk Top.

*Primary Examiner*—Peter A. Aschenbrenner

*Attorney, Agent, or Firm*—Hill, Van Santen, Steadman & Simpson

[57] ABSTRACT

A take-apart pouch tray assembly especially useful for stabilizing a serving tray on an irregular surface including the lap or abdomen of a user, has a rigid planar tray top with a peripheral sidewall receiving the mouth of a pouch or bag in detachable sealed relation. The pouch or bag in turn receives a cushion or pillow partially filled with a very light weight flowable granular material, such as styrofoam. Hook and loop fastener tapes unite the mouth of the pouch or bag with the peripheral wall of the tray. The components of the assembly are easily washed and sterilized.

8 Claims, 1 Drawing Sheet

FIG. 1
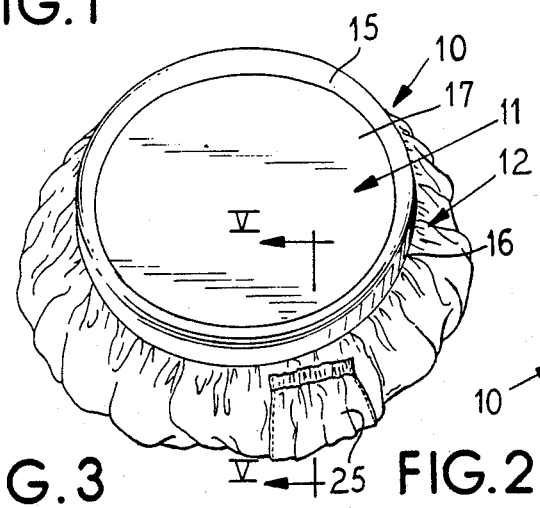
FIG. 2
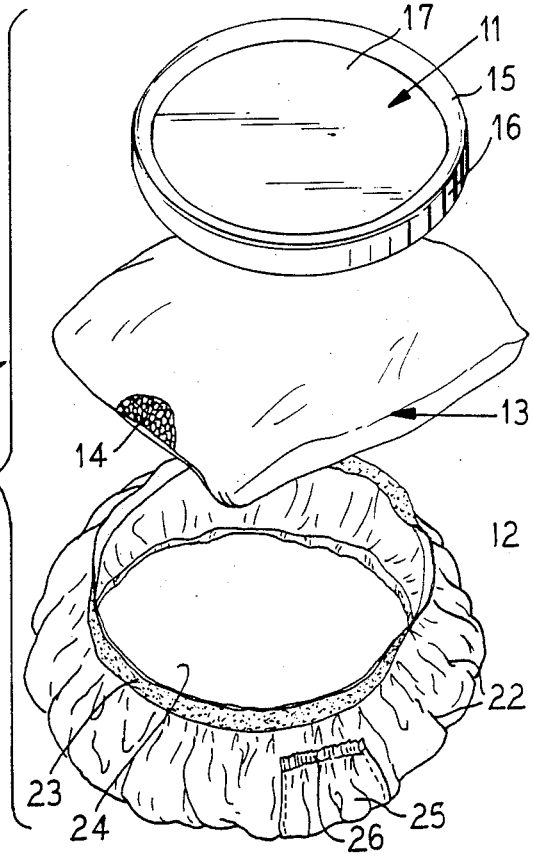
FIG. 3
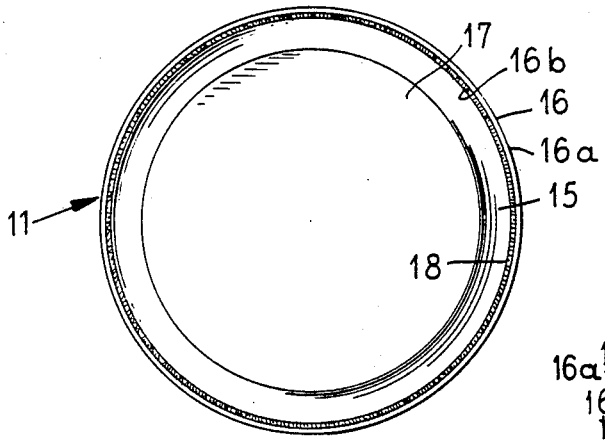
FIG. 5
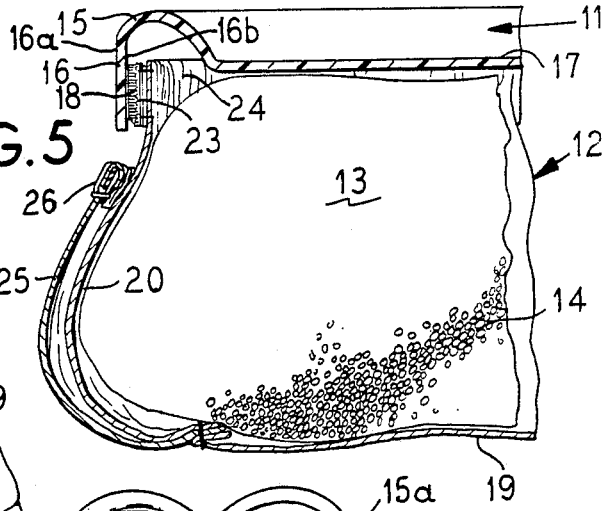
FIG. 4
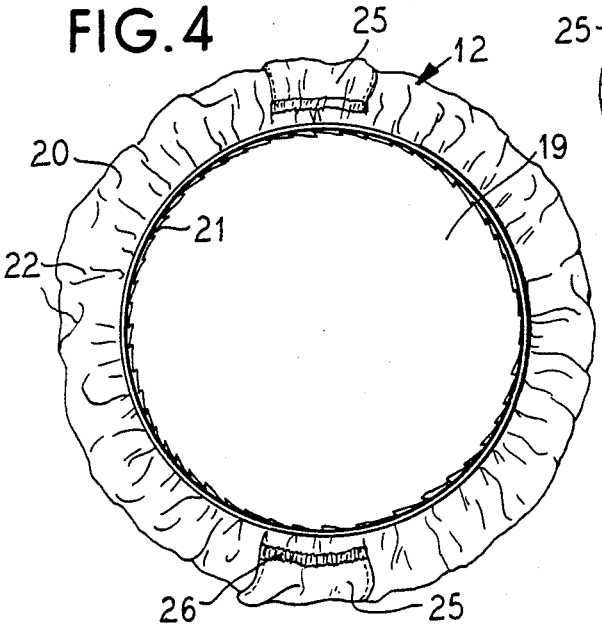
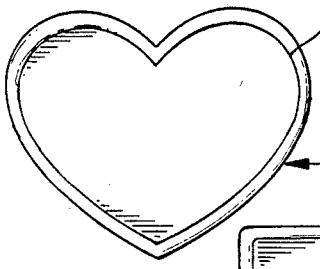
FIG. 6
FIG. 7
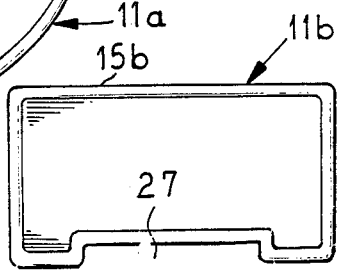

CUSHION POUCH TRAY

FIELD OF THE INVENTION

This invention relates to the art of serving trays and particularly deals with a take-apart light weight washable serving tray with a depending pouch containing a pillow partially filled with granular material which will flow to conform the shape of the pouch with the supporting surface.

BACKGROUND OF THE INVENTION

Prior Art

Heretofore known pouch equipped trays were confined to small heavy devices such as ashtrays, and were unsuitable for relatively large lap or abdomen supported serving trays. These prior known devices were not capable of being taken apart for washing.

It would therefore be an improvement in this art to provide serving trays with removable pouch bags containing cushions or pillows partially filled with a very light weight flowable granular material. Such trays can be large enough to provide ample planar surfaces serving as desks or portable tops for writing pads, books, dishes, cups and the like articles, without substantially adding to the weight of the articles so that the trays can comfortably rest and fit on the lap or abdomen of a user.

SUMMARY OF THE INVENTION

According to this invention, a rigid planar serving tray composed of plastics material, wood, metal, or the like is provided in a desired shape such as circular, rectangular, or novelty shape, such as a heart. The tray unit preferably has a raised bead around its periphery with a depending skirt or flange forming a peripheral sidewall. The size of the tray may vary as desired, but is preferably confined to a size that can be comfortably carried and supported from the lap of a user. A strip of hook or loop fabric ("Velcro") tape is secured by adhesive around the entire periphery of the inner face of the skirt or flange. A washable, limp, open mouth cloth pouch or bag, having a bottom conforming in shape with the tray is detachably suspended from the skirt or flange. This bag has a side piece secured around the periphery of the bottom with gathered stitching forming pleats or folds. The side piece has an open top periphery stitched to a strip of hook or loop fabric ("Velcro") tape mating with the tape on the skirt of the tray. Gathered stitching is also used to secure the sidewall to the strip thus also forming pleats or folds.

One or more open top pockets are stitched to the sidewall of the bag and preferably have elastic tops to retain inserted materials, such as napkins, utensils, letters or the like.

The height of the sidewall of the pouch bag is sufficient so that the bag may comfortably drape over the lap of the user. A sidewall height of about 6 to 8 inches is desirable for trays of sufficient size to support plates, cups, saucers and glasses for meal service. A rectangular tray size of 16 to 24 inches in length and about 10 to 16 inches in width or a circular tray size of about 10 to 14 inches in diameter is sufficient.

The pouch bag freely receives a limp closed bag cushion or pillow partially filled with very light weight granular materials, such as styrofoam pellets. The cushion can be any shape sized to fit within the pouch bag. The granular material or pellets flow freely to conform the shape of the cushion to the shape of the pouch. The pillow is preferably only about ½ filled with the light weight pellets. Different sizes of closed bag pillows can be used to vary the effective height and resistance to deformation of the pouch.

The pouch bag and bag cushion are preferably formed of easily washable cloth fabric, such as cotton, or polyester.

The pillow equipped pouch bag will readily flow to conform with the surface on which the bottom of the pouch will rest and the top tray is thus stabilized in a horizontal position. Changing of the contour of the supporting surface, such as movement of the lap or abdomen of the user, is accommodated without moving the tray.

The attached sheet of drawings shows preferred mode embodiments of the invention in which:

FIG. 1 is a perspective view of a cushion pouch tray of this invention;

FIG. 2 is an exploded view of the components of the tray assembly of FIG. 1;

FIG. 3 is a bottom plan view of the rigid tray component of FIGS. 1 and 2;

FIG. 4 a bottom plan view of the pouch bag component of FIGS. 1 and 2;

FIG. 5 is a vertical cross-sectional view along the line V—V of FIG. 1;

FIG. 6 is a top plan view of a heart-shaped tray useful in the assembly of this invention;

FIG. 7 a top plan view of a rectangular tray useful in the assembly of this invention.

As shown in FIG. 1, the cushion pouch tray assembly 10 is composed of a rigid service tray top 11 with a depending limp pouch or bag 12.

As shown in FIG. 2, the tray assembly 10 includes a limp cushion or pillow 13 partially filled with very light weight granules or pellets 14.

The rigid tray 11 has a raised rim or bead 15 around its periphery from which depends a skirt or flange 16. The bead 15 may vary in height as desired and is usually in the range of ½ to 1 inch to provide a retaining wall around the central or flat top portion 17 of the tray. The top of the bead 15 is preferably arcuate to merge into the skirt 16 and top 17. The skirt preferably has a depth of 1½ to 2 inches.

As shown in FIG. 3, the skirt 16 has an outer face **16*a* and an inner face 16*b*. A strip of hook or loop fastener fabric tape ("Velcro") 18 is secured to the inner face 16*b*** of the skirt around its entire periphery by means of adhesive.

The pouch bag 12 as shown in FIG. 4, has a bottom 19 conforming in shape and size with the tray 11. A sidewall 20 is stitched around the periphery of this bottom 19 by gather stitching 21 to provide pleats or folds 22. The top of the sidewall 20 is stitched to a strip of hook or loop fabric tape ("Velcro") 23, as shown in FIG. 2. Gather stitching is also used to complete the folds 22 thus facilitating bulging of the pouch. The strip 23, of course, interlocks with the strip 18 providing a releasable sealed connection between the tray 11 and pouch bag 12.

The pouch bag 12 has an open top mouth 24 surrounded by the strip 23 generally conforming with the skirt 16 so that the strips 18 and 23 will mate.

A pair of diametrically opposed open top pockets 25 are stitched to the side 20 of the bag between the bottom 19 and mouth 24. These pockets 25 have elastic tapes 26 stitched in the top lips thereof to hold them in a closed position until stretched by inserted material, such as napkins, utensils, letters, and the like.

The cushion or pillow 13 is only about half filled with the granular material or pellets 14 and need not conform in shape with the pouch since it is easily tucked into the interior of the pouch and will conform to its shape.

As illustrated in FIG. 1, the gathered stitching forming the folds or pleats of the sidewall 20 of the pouch permits it to bulge outwardly and easily drape over and conform with the shape of the supporting surface.

As illustrated in FIGS. 6 and 7, modified tray shapes 11*a* and 11*b* may be provided. Thus, the tray 11*a* is shaped in the form of a heart to provide a novelty item and has a raised bead 15*a* conforming to this shape. In FIG. 7 the tray 11*b* is generally rectangular shaped with a raised peripheral bead 15*b*. A recess 27 may be provided in one side of the rectangular tray 11*b* to permit the tray to be fitted around the lap of a user.

From the above descriptions it will be understood that this invention provides a stabilized light weight sanitary serving tray assembly especially useful as a lap or abdomen supported tray conforming in shape with its support surface without tilting the top of the tray. The assembly is easily separated into its components for washing and is especailly useful in nursing homes, hospitals and the like where sterilization is desired.

I claim as my invention:

1. A light weight washable sanitary contour conforming tray assembly adapted to be supported on the lap or abdomen of a user which comprises a rigid planar top tray having a peripheral depending sidewall, a limp open top pouch depending from said sidewall, a pair of mating hook and loop fabric tapes respectively secured around said sidewall and around the open top of the pouch to detachably suspend the pouch from the sidewall of the tray, a removable and replaceable limp closed bag in said pouch, light weight flowable granules partially filling said closed bag, and said bag being easily removed and replaced with a different sized granule containing bag to selectively provide a cushion having a desired height and resistance to deformation to accommodate a user for causing the pouch to drape over the lap or abdomen of the user and conform therewith without tiling the planar tray.

2. A take-apart rigid flat top pouch device which comprises a planar rigid member having a depending peripheral skirt with an inner face, an open mouth pouch bag suspended from the inner face of said skirt around the mouth thereof, a pair of mating hook and loop fabric tapes respectively secured to said inner face around the entire periphery of the skirt and around the outside of the entire open mouth of the pouch, a closed limp bag partially filled with flowable light weight granules fitted freely in said pouch effective to drape the pouch into comformity with a support surface without tilting the planar rigid member, said tapes in their mated condition securing the pouch and rigid member together and sealing the interior of the pouch and in their separated condition permitting separation of the rigid member, pouch and closed bag to facilitate sterilization of all of the components.

3. A lap supported serving tray comprising a rigid planar to member with a depending integral skirt, an open top limp cloth pouch bag having a bottom conforming in size and shape with the top member, an outwardly bulged pleated side wall and a pocket on the sidewall, a first tape secured around the open top of the bag, a second tape secured around the inside of the skirt, said first and second tapes having cooperating mating hooks and loops to seal and secure the bag to the skirt, and flowable granules partially filling the bag.

4. The device of claim 2 wherein the planar rigid member has a raised rim therearound.

5. The device of claim 2 wherein the granules are styrofoam.

6. The device of claim 2 including a pair of diametrically opposed open top pockets on the pouch bag.

7. The tray of claim 3 including a sealed porous bag in the cloth bag housing the granules.

8. The tray of claim 3 having a heart shape.

* * * * *